United States Patent [19]

Edwards

[11] Patent Number: 4,565,346

[45] Date of Patent: Jan. 21, 1986

[54] ADJUSTABLE BRACKET MOUNT

[76] Inventor: Ivan J. Edwards, 1200 Holiday Pl., Bossier City, La. 71112

[21] Appl. No.: 529,484

[22] Filed: Sep. 6, 1983

[51] Int. Cl.[4] ..... H01Q 1/00

[52] U.S. Cl. ..... 248/558; 248/122; 248/296; 403/4; 343/840

[58] Field of Search ..... 248/122, 274, 282, 283, 248/285, 296, 558; 403/3, 4; 343/840

[56] References Cited

U.S. PATENT DOCUMENTS

| | | | |
|---|---|---|---|
| D. 237,941 | 12/1975 | Dotter | 248/539 |
| 462,265 | 11/1891 | Mason | 248/274 |
| 551,358 | 12/1895 | Benecke | 248/296 |
| 1,149,762 | 8/1915 | Hendrickson | 248/296 |
| 1,220,299 | 3/1917 | Viden | 248/541 X |
| 1,375,888 | 4/1921 | Baer | 248/296 |
| 1,511,630 | 10/1924 | Ozlek | 248/122 |
| 2,258,175 | 10/1941 | Coleman | 248/122 |
| 2,294,986 | 9/1942 | Hynek | 248/530 |
| 3,041,708 | 7/1962 | Holtz | 248/188 |
| 3,167,292 | 1/1965 | Meyerowitz | 248/161 |
| 4,047,684 | 9/1977 | Kobayashi | 248/122 |
| 4,142,190 | 2/1979 | Kerr | 343/840 |

FOREIGN PATENT DOCUMENTS

| | | | |
|---|---|---|---|
| 47247 | 11/1936 | France | 248/122 |

OTHER PUBLICATIONS

Delco-Remy, "DR Instruction Sheet", DR-9134, Dec. 1, 1967.

*Primary Examiner*—J. Franklin Foss
*Assistant Examiner*—Robert A. Olson
*Attorney, Agent, or Firm*—John M. Harrison

[57] ABSTRACT

An adjustable bracket mount for mounting certain functional components such as a feed horn and a low noise amplifier on a satellite antenna dish at the prime focus or other desired location above the antenna dish, which mount includes a base secured to the dish, a bottom support extending from the base toward the prime focus, an offset bracket in adjustable cooperation with the bottom support and carrying a top support which extends in parallel relationship to the bottom support and projects above the bottom support and a top bracket adjustably mounted on the top support to carry the functional components.

1 Claim, 5 Drawing Figures

ADJUSTABLE BRACKET MOUNT

BACKGROUND OF THE INVENTION

1. Field of the Invention

This invention relates to satellite antennas for transmitting and receiving radio and television signals to and from satellites located in a geosynchronous orbit around the earth and more particularly, to an adjustable bracket mount for securely, accurately and removably positioning the feed horn and low noise amplifier, or the feed assembly components of the satellite antenna at the prime focus, or the point toward which the satellite dish reflects and concentrates the signals. A primary feature of the invention is the versatile nature of the adjustable bracket mount, which facilitates positioning of the feed horn and low noise amplifier at various distances from the center of a variety of selected antenna dishes in order to locate the feed assembly precisely at the prime focus of the antenna. Another important feature of the adjustable bracket mount of this invention is the stability of the bracket, which is designed to securely and positively, yet removably, mount the feed horn and low noise amplifier with minimum vibration in a precise location with respect to the prime focus of the antenna.

2. Description of the Prior Art

Various mounting brackets and systems for securing the feed horn and low noise amplifier or feed assembly to the dish of a satellite antenna at the prime focus of the antenna are known in the art. Typical of these devices is the commonly used four leg mount and the tripod mount, the latter of which is illustrated in FIG. 1 of applicant's drawing and is labeled "PRIOR ART". The tripod and four leg mechanical supports suffer from the disadvantage of requiring three or four mounting points on the satellite dish, which points of attachment must be carefully chosen in order to ensure that the necessary feed assembly components of the antenna, which are secured to the apex of the pyramid formed by the three or four bracket legs, are located at the prime focus of the antenna. Furthermore, supports having legs of different lengths for each selected antenna dish of a different size are required, since the prime focus is different for satellite antennas of varying size and dish design.

Other mounting brackets and assemblies such as the single-leg mount, are also known in the art. This mount consists of a single rod or tube extending outwardly at an angle from the antenna dish to the prime focus, with the attitude angle chosen such that the feed assembly is mounted at the prime focus. These brackets are difficult to mount securely such that the feed horn and low noise amplifier are free from undesirable vibration, which blurs the television image. A variation of the single leg support is the mount support which is offset by a double bend from a point of attachment to the dish, in order to locate the top of the bracket and the antenna feed assembly at the prime focus of the satellite antenna.

Accordingly, it is an object of this invention to provide a new and improved adjustable bracket mount for supporting the feed horn and low noise amplifier in a wide variety of satellite antennas, which bracket mount is stable, relatively free of vibration and is designed to locate the feed assembly components at the prime focus of these antennas.

Another object of this invention is to provide an adjustable bracket mount for securely and positively, yet adjustably and removably supporting certain functional antenna components such as the feed assembly, at the prime focus or other desired location above the antenna dish in satellite antennas of various size and design.

Yet another object of the invention is to provide a new and improved adjustable bracket mount for mounting on the dish of a satellite antenna and securely, yet adjustably, supporting the antenna feed assembly at the prime focus of the antenna, which bracket mount is characterized by a base secured to the antenna dish, an offset bracket adjustably carried by a bottom support slidably and rotatably mounted in the base, the offset bracket adjustably supporting a top support and a feed horn bracket adjustably attached to the top support and designed to receive a feed horn and precisely locate a feed assembly at the prime focus of the antenna.

A still further object of the invention is to provide an adjustable bracket mount for locating an antenna feed assembly at the prime focus of a satellite antenna, which bracket mount includes a base secured to the antenna dish; a bottom support slidably and rotatably extending from the base toward the prime focus; an offset bracket rotatably and slidably carried by the bottom support and rotatably and slidably attached to a top support which is parallel to and offset above the bottom support; and a feed horn bracket rotatably and slidably carried by the top support and spaced from the offset bracket, to facilitate positioning of the feed assembly at various prime focus locations in a wide variety of satellite antennas of various design and size.

SUMMARY OF THE INVENTION

These and other objects of the invention are provided in a new, improved and versatile adjustable bracket mount for supporting the feed assembly in a satellite antenna, which bracket mount includes a base secured to the antenna dish at a point near the center of the dish; a bottom tubular support projecting from the base in adjustable relationship and secured in the base by means of an allen screw; an offset bracket having one end adjustably secured to the bottom tubular support and located in a desired position on the bottom tubular support by a second allen screw; a top tubular support adjustably positioned on the opposite end of the offset bracket and secured in a selected position on the offset bracket by a third allen screw; and a feed horn bracket adjustably secured to the opposite end of the top tubular bracket and stablized by a fourth allen screw, to locate the antenna feed assembly at the desired prime focus.

BRIEF DESCRIPTION OF THE DRAWING

The invention will be better understood by reference to the accompanying drawing, wherein.

DESCRIPTION OF THE PREFERRED EMBODIMENTS

Figure 1:
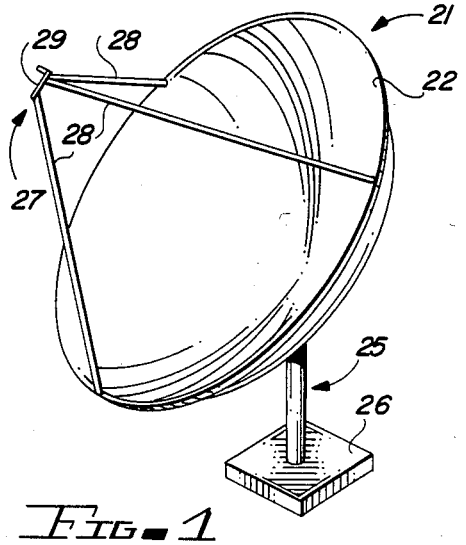
FIG. 1 (PRIOR ART)
FIG. 1 is a perspective view of a satellite antenna having a conventional tripod feed assembly mount secured to the antenna dish.

Referring now to FIG. 1 of the drawing a typical conventional satellite antenna 21 is illustrated, which includes an antenna dish 22, constructed of fiberglass, aluminum or other materials known to those skilled in the art and supported by an antenna support 25, mounted on a suitable foundation 26. A conventional tripod mount 27 is characterized by three tripod legs 28, extending from attachment to a feed horn mount 29 to spaced points of attachment to the antenna dish 22, as illustrated. A feed horn and low noise amplifier [not illustrated] can be secured to the feed horn mount 29 and the tripod legs 28 are sufficiently long and the tripod mount 27 so designed to locate the antenna feed assembly at the prime focus of the satellite antenna 21. It will be further appreciated that the antenna dish 22 of the satellite antenna 21 can be designed to pivot with respect to the antenna support 25 in order to aim the satellite antenna 21 at a satellite placed in a geosynchronous orbit above the earth.

Figure 2:
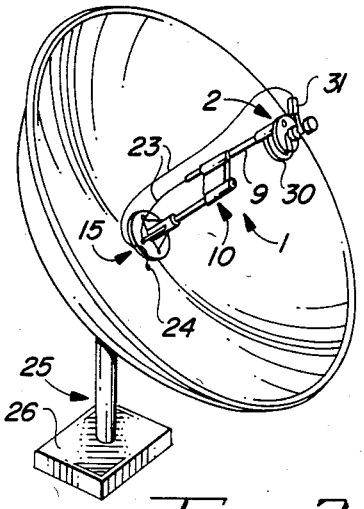
FIG. 2 is a perspective view of a satellite antenna having an adjustable bracket mount secured to the antenna dish and supporting the feed assembly.
Figure 3:
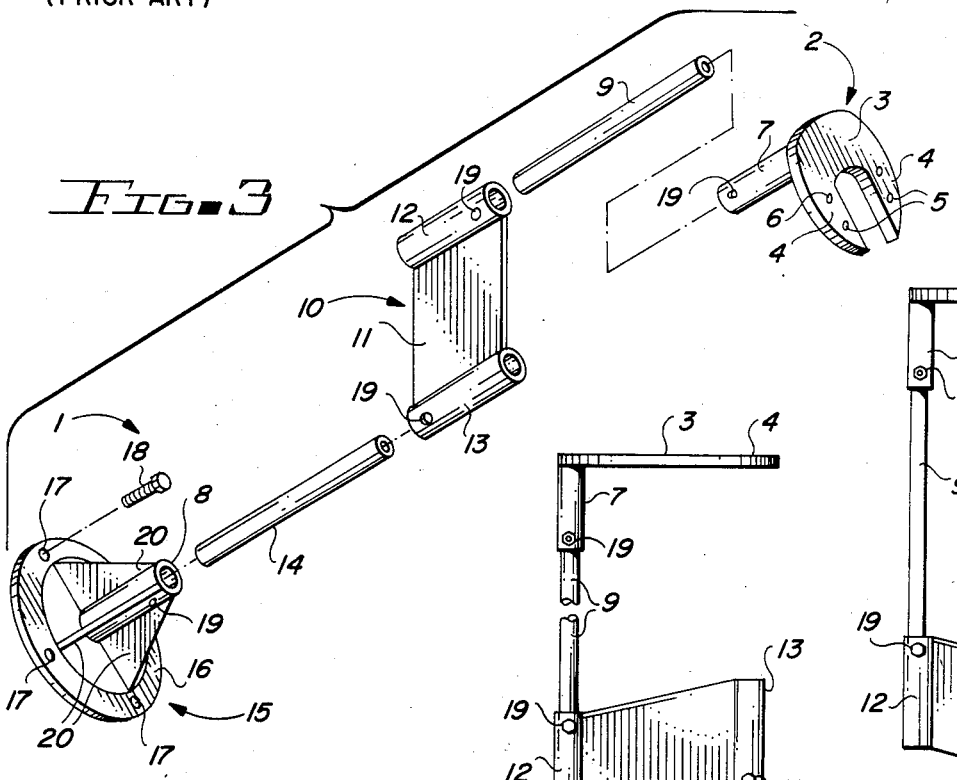
FIG. 3 is an exploded view of a preferred embodiment of the adjustable bracket mount of this invention.

Referring now to FIGS. 2 and 3 of the drawing in a preferred embodiment, the adjustable bracket mount of this invention is generally illustrated by reference numeral 1 and is positioned on the antenna dish 22 of a satellite antenna 21. The adjustable bracket mount 1 is characterized by a base 15, having a base flange 16 which is provided with base flange apertures 17, designed to receive mounting bolts 18 in order to secure the base 15 to the antenna dish 22. A base receptacle 8 extends upwardly from the base flange 16 and is supported by receptacle supports 20. An offset bracket 10, which includes a bracket web 11 situated between a top support collar 12 and a bottom support collar 13, serves to space a top support 9 above and parallel to a bottom support 14, which bottom support 14 is selectively slidably and rotatably mounted in the base receptacle 8 of the base 15. The bore of the top support collar 12 is slightly larger than the outside diameter of the top support 9, in order to facilitate slidable and rotatable movement of the top support 9 inside the top support collar 12. Similarly, the bore of the bottom support collar 13 is slightly larger than the outside diameter of the bottom support 14, in order to facilitate slidable and rotatable movement of the bottom support collar 13 and the offset bracket 10, on the bottom support 14. The top support 9 can be stabilized inside the top support collar 12 and the bottom support 14 secured inside the bottom support collar 13 at selected locations by means of allen screws 19, which are threadibly inserted in the top support collar 12 and the bottom support collar 13, for purposes which will be hereinafter described. A feed horn bracket 2, consisting of a bifurcated bracket plate 3, defining spaced bracket fingers 4, which in turn define a plate slot 6, is secured in slidable and rotatably relationship to the top end of the top support 9, by means of a plate neck 7, which threadibly carries an allen screw 19. Finger apertures 5, located in the bracket plate 3, serve to accommodate additional mounting bolts 18, in order to mount a conventional feed horn 30 to the bracket plate 3. A low noise amplifier 31 is in turn attached to the feed horn 30 in conventional fashion and the necessary wiring 23 extends from the feed horn 30 and the low noise amplifier 31 through the wiring aperture 24, in the antenna dish 22, in order to transmit a signal received by the satellite antenna 21 to additional electronic equipment which facilitates an image on a television set.

Figure 4:
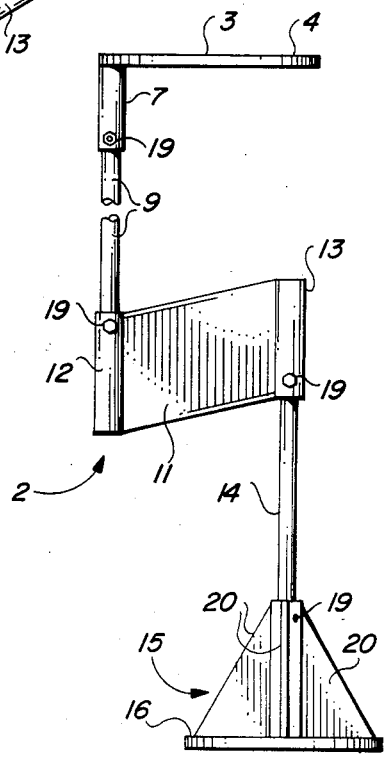
FIG. 4 is a side elevation of the bracket mount illustrated in FIG. 3.

Referring now to FIGS. 2, 3 and 4 of the drawing it will be appreciated that the adjustable bracket mount 1 of this invention is capable of being adjusted to locate the feed horn 30 and low noise amplifier 31 at many desired positions above a selected antenna dish 22 and the antenna feed assembly components at the prime focus of substantially any satellite antenna 21. This adjustment is accomplished by loosening one or more of the allen screws 19 located in the top support collar 12, the bottom support collar 13, the base receptacle 8 and the plate neck 7. The feed horn bracket 2 can then be slidably positioned on the top support 9, the top support 9 slidably manipulated in the top support collar 12, the bottom support collar 13 slidably adjusted on the bottom support 14, and the bottom support 14 adjusted in the base receptacle 8. In this manner, the height of the feed horn 30 and low noise amplifier 31 above the center of the antenna dish 22 can be determined and easily set by tightening the respective allen screws 19. Furthermore, if the center of the antenna dish 22 is assumed to be at the wiring aperture 24 as illustrated in FIG. 2, the feed horn 30 can be manipulated to the most desirable position directly over the wiring aperture 24, by rotational adjustment of the feed horn bracket 2 with respect to the top support 9 and/or additional rotational adjustment of the offset bracket 10 with respect to the base 15, as described above. Accordingly, it will be appreciated by those skilled in the art that in the event that the adjustable bracket mount 1 is used in cooperation with a satellite antenna 21 having a larger antenna dish 22 than the antenna dish illustrated in FIG. 2, then the appropriate adjustments can be made as heretofore described, in order to extend the height of the feed horn 30 and the low noise amplifier 31 to the new prime focus location of the larger satellite antenna.

Figure 5:
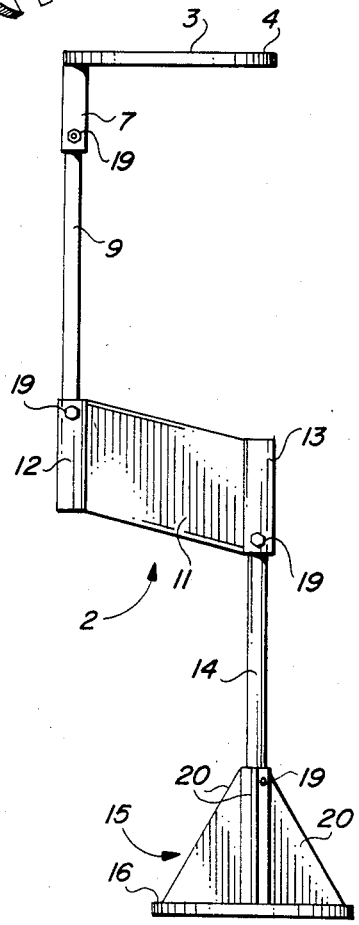
FIG. 5 is a side elevation of the bracket mount illustrated in FIG. 4, with the offset bracket reversed.

Referring now to FIG. 5 of the drawing, under circumstances where additional height is desired in order to locate the feed horn 30 and low noise amplifier 31 at a selected point which is above the location illustrated in the satellite antenna 21 shown in FIG. 4, the offset bracket 10 can be reversed such that the top support collar 12 is in the top position and the bottom support collar 13 is in the bottom position, in order to gain additional height without the necessity of using a different adjustable bracket mount 1. The height of the feed horn bracket 2 above the antenna dish 22 can also be increased by securing the top support collar 12 of the offset bracket 10 to the bottom most portion of the top support 9, extending the bottom support 14 to a maximum height in the base receptacle 8 of the base 15, sliding the top segment of the bottom support 14 downwardly as far as possible in the bottom support collar 13 and extending the plate neck 7 upwardly to maximum extension on the top segment of the top support 9. In this manner, the height of the feed horn bracket 2 can be adjusted to accord with a wide range of prime focus locations on satellite antennas of various design and size.

It will be appreciated by those skilled in the art that the adjustable bracket mount of this invention can be used in substantially any satellite antenna of the dish design, wherein one or more functional components of the antenna must be suspended positively above the antenna dish. Accordingly, whether the antenna is designed to transmit an uplink signal or to receive a downlink signal, the adjustable bracket mount can be secured to the antenna dish and adjusted as described above, to precisely and securely locate the suspended transmitting or receiving components in the prescribed location.

It will be further appreciated that other fastening means such as threaded bolts and the like, can be used in place of the allen screws 19 to selectively secure the respective components of the adjustable bracket mount 1 in rigid configuration, according to the knowledge of those skilled in the art.

While the preferred embodiment of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In a satellite antenna having an antenna dish and a feed assembly, an adjustable bracket mount for supporting the feed assembly above the antenna dish, comprising:

(a) a base characterized by a base flange for mounting on the antenna dish, said base characterized by an elongated, hollow base receptacle secured to said base flange and receptacle supports bracing said base receptacle to said base in spaced relationship;

(b) a round bottom support in telescoping cooperation with said base receptacle and a first allen screw threadably cooperating with said base and selectively engaging said bottom support for removably securing said bottom support to said base receptacle;

(c) an offset bracket having a round bottom support collar in telescoping cooperation with said bottom support above said base and a second allen screw threadably cooperating with said bottom support collar and selectively engaging said bottom support for removably securing said bottom support in said bottom support collar; a round top support collar spaced from said bottom support collar; and a flat web spacing said top support collar in a first horizontal plane located at the center transverse axis of said top support collar and said bottom support collar in a second horizontal plane located at the center transverse axis of said bottom support collar;

(d) a round top support in telescoping cooperation with said top support collar and a third allen screw threadably cooperating with said top support collar and selectively engaging said top support for removably securing said top support in said top support collar; and (e) a top bracket having a round to bracket collar in telescoping cooperating with said top support and a pair of elongated plate fingers extending in substantially parallel relationship with respect to each other from said top bracket, and a fourth allen screw threadibly cooperating with said top bracket collar and selectively engaging said top support for removably securing said top support in said top bracket collar.

* * * * *